United States Patent [19]

Morikawa et al.

[11] Patent Number: 5,016,051

[45] Date of Patent: May 14, 1991

[54] ELECTROPHOTOGRAPHIC COPYING MACHINE WITH DEVICE FOR SHIFTING AN IMAGE

[75] Inventors: Takeshi Morikawa; Kaoru Hashimoto; Hiroyuki Ideyama, all of Osaka, Japan

[73] Assignee: Minolta Camera Kabushiki Kaisha, Osaka, Japan

[21] Appl. No.: 432,392

[22] Filed: Nov. 8, 1989

Related U.S. Application Data

[63] Continuation of Ser. No. 141,717, Jan. 11, 1988, abandoned.

[30] Foreign Application Priority Data

Jan. 10, 1987 [JP] Japan ..... 62-3687
Jan. 10, 1987 [JP] Japan ..... 62-3688
Jan. 28, 1987 [JP] Japan ..... 62-18871

[51] Int. Cl.[5] ..... G03G 21/00

[52] U.S. Cl. ..... 355/218; 355/233; 355/243

[58] Field of Search ..... 355/208, 218, 233, 243, 355/55, 235

[56] References Cited

U.S. PATENT DOCUMENTS

| | | | |
|---|---|---|---|
| 4,183,656 | 1/1980 | Ishihara et al. | 355/8 |
| 4,211,482 | 7/1980 | Arai et al. | 355/8 |
| 4,260,242 | 4/1981 | Nishikawa | 355/14 TR |
| 4,371,255 | 2/1983 | Satomi | 355/14 SH X |
| 4,451,136 | 5/1984 | Tanioka et al. | 355/14 SH |
| 4,707,126 | 11/1987 | Ohshima et al. | 355/14 SH |
| 4,714,941 | 12/1987 | Yamagishi et al. | 355/8 |

*Primary Examiner*—A. T. Grimley
*Assistant Examiner*—Robert Beatty
*Attorney, Agent, or Firm*—Burns, Doane, Swecker & Mathis

[57] ABSTRACT

A copying machine of the scanning exposure type has a device for entering the position on a copy sheet where a copy image corresponding to a document image is to be formed. According to the input from the device, the operation timing of a feeder is controlled which feeds the copy sheet to a position where an image formed by scanning exposure on a photosensitive member is transferred from the member to the sheet, such that the copy image is formed on the specified position on the sheet. When an edition copy mode is set or the image forming position input is given with the setting of this mode, the scanner is controlled to move a distance which permits a shift of the document image as specified by the position input.

19 Claims, 9 Drawing Sheets

Fig. 1a
PRIOR ART
Fig. 1b
PRIOR ART
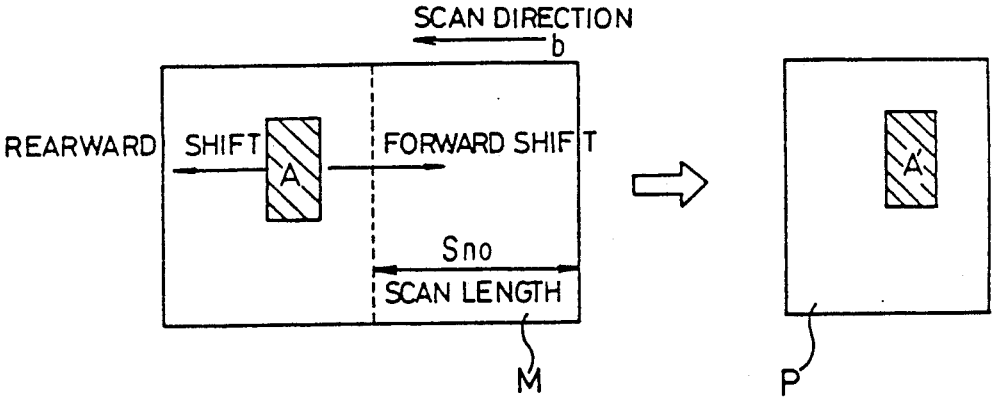
Fig.2
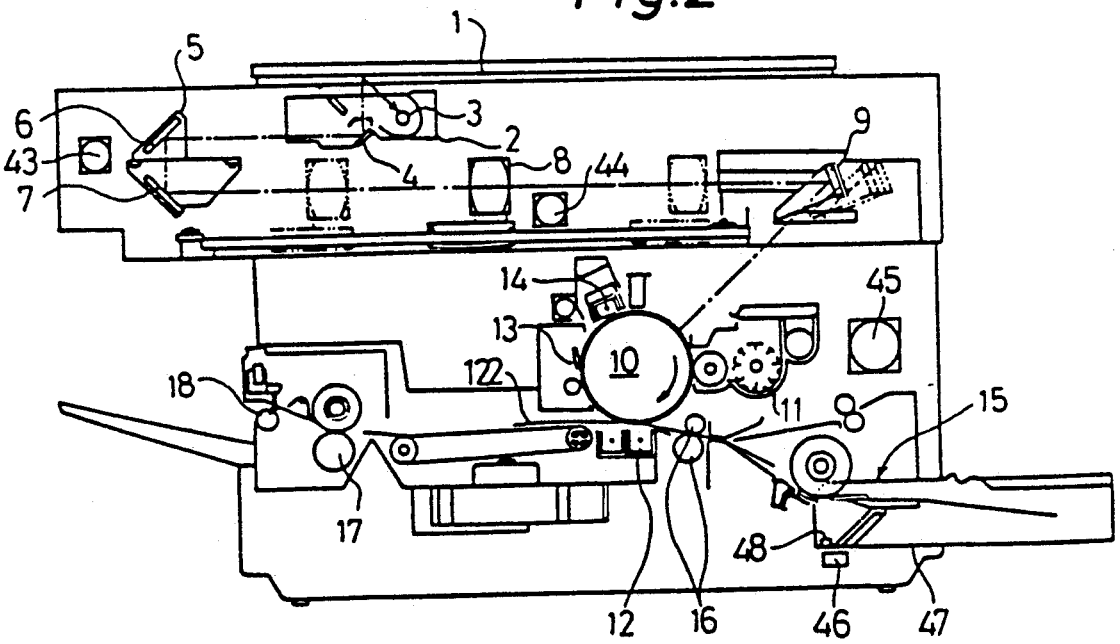

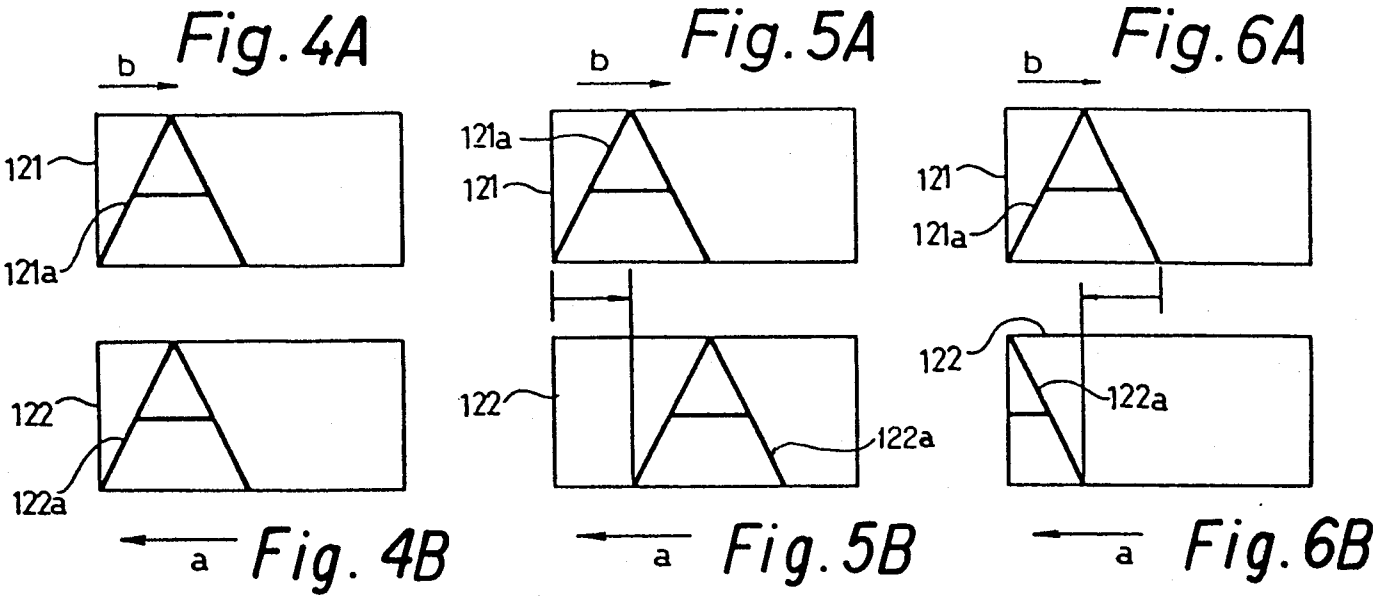
Fig. 4A
Fig. 4B
Fig. 5A
Fig. 5B
Fig. 6A
Fig. 6B
121
121a
122
122a
a
b
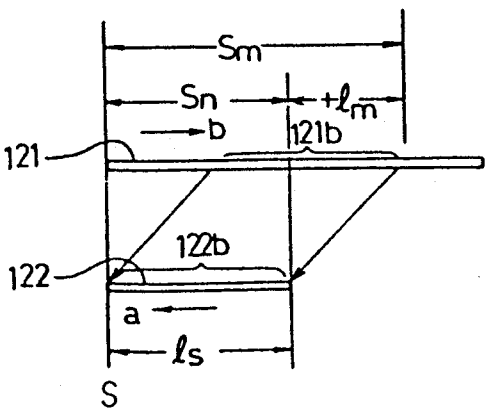
Fig. 7
Fig. 8
Sm
Sn
+ℓm
-ℓm
121b
122b
ℓs
121
122
a
b
S

ELECTROPHOTOGRAPHIC COPYING MACHINE WITH DEVICE FOR SHIFTING AN IMAGE

This application is a continuation of application Ser. No. 07/141,717, filed Jan. 11, 1988, now abandoned.

BACKGROUND OF THE INVENTION

The present invention relates to an electro-photographic copying machine of the scanning exposure type wherein a photosensitive member is exposed to a document image by a scanning system to form an image corresponding to the document image on the member, and the image is then transferred onto a copy sheet. More particularly, the invention relates to a scanning means control system which is advantageous for use in such a copying machine to shift the image to be formed on the copy sheet from the image position on the document in the direction of scanning.

U.S Pat. No. 4,260,242 (Apr. 7, 1981) and U.S. Pat. No. 4,451,136 (May 29, 1984) disclose copying machines which are adapted to shift images in such a manner for edition.

These machines are designed to vary the registration timing for a copy sheet to be fed to the position where the image on the photosensitive member is transferred onto the copy sheet.

This will be described specifically with reference to a document M shown in FIG. 1 (*a*) and having an image A, and with a copy sheet P, shown in FIG. 1 (*b*), on which the document image A is to be formed as a copy image A'.

When the document M of FIG. 1 (*a*) is scanned in the direction of arrow b from its right end, an image is formed on the copy sheet P of FIG. 1 (*b*) from its right end in the same direction as the scanning direction. In the case of usual registration timing, the position of the image A' formed on the sheet P corresponds to the position of the image A on the document M. However, the copy sheet P is ½ the size of the document M in the scanning direction. It is therefore the image portion of the document M over a scanning length Sno corresponding to the size of the copy sheet P that can be reproduced on the sheet P with the usual timing, and it is impossible to copy the image A of the document M on the sheet P.

Accordingly, if the registration timing is delayed by an amount corresponding to ½ the size of the document M in the scanning direction, the document image can be shifted on the copy sheet P in the scanning direction. Thus, the image A on the document M is formed as the copy image A' in the illustrated position on the sheet P.

The document image can be copied as shifted in this way only when the image is within the scanning range. Accordingly, even if one attempts to employ the system disclosed in U.S. Pat. No. 4,211,482 (Jul. 8, 1980) which is adapted to determine the scanning length from the copy sheet size and the magnification to avoid useless scanning action outside the required range and needless waste of time, the machine fails to reproduce the image outside the area specified by the system according to the sheet size and the magnification. Such a failure could be avoided by an operator setting the desired scanning length, but that procedure is cumbersome and inefficient.

SUMMARY OF THE INVENTION

A first object of the present invention is to provide an electrophotographic copying machine which is automatically so controllable as to scan documents to a minimum essential extent in the usual copy mode which involves no shift of images and to effect sufficient scanning for the reproduction of entire document images in an edition copy mode that involves a shift of the image, the machine thus being made convenient to use and capable of forming images free of any problem.

A second object of the invention is to provide an electrophotographic copying machine wherein the scanning means is controllable as required in the edition copy mode by simple means.

A third object of the invention is to provide an electrophotographic copying machine wherein the documents to be copied in the edition mode are scanned as required to a minimum extent at all times without any useless scanning action and waste of time.

Other objects and features of the invention will become apparent from the following description with reference to the accompanying drawings.

BRIEF DESCRIPTION OF THE DRAWINGS

FIGS. 1 (*a*) and (*b*) are diagrams illustrating the relationship between the position of an image on a document and the position of an image formed on a copy sheet with a shift of the document image;

FIG. 2 is a sectional view schematically showing an electrophotographic copying machine to which the invention is applied;

FIGS. 4 to 6 are diagrams illustrating in greater detail the image position relationship between a document and a copy sheet in the usual copy mode and an edition copy mode;

FIGS. 7 and 8 are diagrams illustrating the relationship between the shift of the image and the required scanning length;

Throughout the embodiment, like parts and portions are designated by like reference numerals and symbols, and repeated designations are omitted.

DETAILED DESCRIPTION OF THE INVENTION

Figure 3:
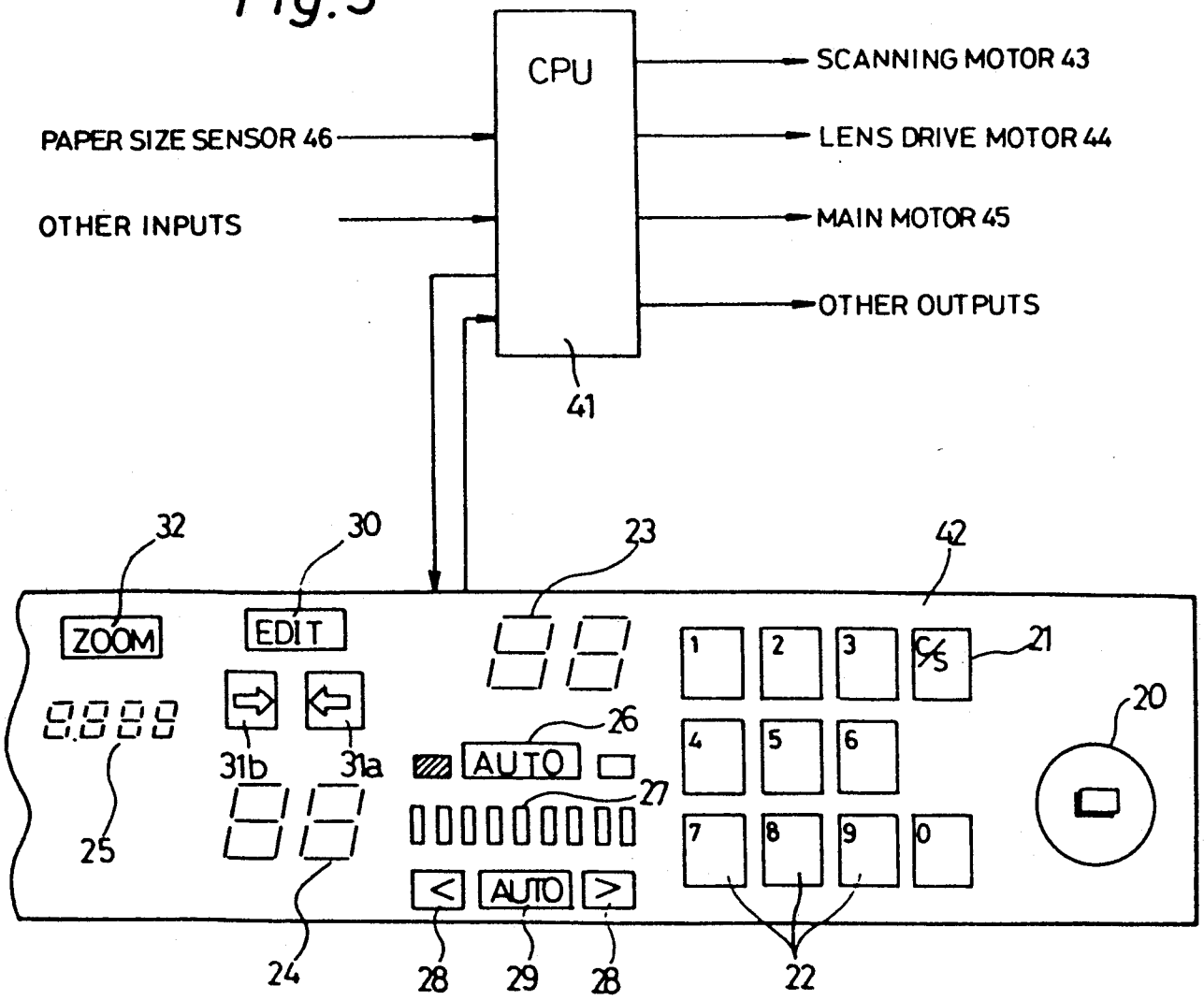
FIG. 3 is a block diagram showing the operation panel and the control circuit of the copying machine of FIG. 2.

Embodiments of the invention will be described below with reference to the drawings.

FIG. 2 shows an electrophotographic copying machine to which the invention is applied and which includes control means for shifting images. The basic construction of the copying machine, although similar to that of known ones, will be described briefly.

Indicated at 1 is a document support table, at 2 a first carriage serving as a scanner and carrying a light source 3 and a first mirror 4, and at 5 a second carriage equipped with second and third mirrors 6, 7. The first carriage 2 moves below the document table 1 for scanning. While the first carriage 2 moves at a velocity of V/n (V: peripheral speed of a photosensitive member 10, n: copy magnification), the second carriage 5 moves at a velocity of V/2n with the first carriage 2 to maintain the optical path at a constant length despite the scanning movement. Indicated at 8 is a photographic lens, at 9 a fourth mirror and at 10 the above-mentioned photosensitive member. An image of a document on the table 1 is projected onto the member 10. Arranged around the photosensitive member 10 are a developing unit 11, transfer charger 12, cleaner 13 and sensitizing charger 14. Indicated at 15 is a paper feeder for sending out copy sheets 122 one by one, at 16 a pair of register rollers, at 17 a fixing unit, and at 18 a discharge roller.

The lens 8, when shifted axially thereof, varies the magnification at which the document image is projected on the photosensitive member 10. More specifically, the lens 8, when moved leftward in FIG. 1, gives a reduced magnification, whereas the rightward movement of the lens 8 gives an increased magnification. An electrostatic latent image of a size corresponding to the magnification is formed on the member 10, and the image is developed to a toner image, which is then transferred onto the copy sheet 122 and fixed thereto.

Accordingly, the copy image formed on the sheet 122 has a magnification of 1× or a smaller or greater magnification in accordance with the position of the lens 8.

On the other hand, the pair of register rollers 16 is usually at rest for temporarily halting the copy sheet 122 forwarded from the feeder 15 and properly positioning the leading end of the sheet to preclude skew. The time at which the pair of rollers 16 is initiated into rotation determines the registeration timing for the sheet 122 to be fed to the transfer station.

In the usual copy mode, the registration timing is so determined that the leading-end position of the copy sheet 122 is registered at the transfer station with the front-end position of the image to be formed on the photosensitive member 10. Consequently, a particular image 121*a* on a document 121 as shown in FIG. 4 is copied on a copy sheet shown in FIG. 4 and has the same size as the document 121, at the same position as on the document, giving a copy bearing a copy image 122*a* at the same position as the document 121.

If the registration timing is made earlier to cause the leading-end position of the copy sheet 122 to precede the front-end position of the document image on the photosensitive member 10, the image 121*a* on the document 121 is copied on the sheet 122 at a position shifted rearward from the image position on the document 121 rearward with respect to the direction a of transport of the sheet, giving a copy bearing a copy image 122*a* as shifted rearward relative to the document 121 as seen in FIG. 5. The result is the same as when the image 121*a* on the document 121 is copied at a position shifted downstream with respect to the scanning direction b. This will hereinafter be referred to as "rearward shift."

Further when the registration timing is delayed to position the leading end of the copy sheet 122 to the rear of the front end of the document image on the photosensitive member 10, the image 121*a* on the document 121 is copied on the sheet 122 at a position shifted forward from the image position on the document 121 forward with respect to the direction a of transport of the sheet as shown in FIG. 6, giving a copy with a copy image 122*a* as shifted forward from the image position on the document 121. The result is the same as when the image 121*a* on the document 121 is copied as shifted upstream with respect to the scanning direction b. This will hereinafter referred to as "forward shift."

On the other hand, the scanning length Sn required for the usual copy mode is given by:

$$Sn = ls/M$$

wherein ls is the size of the copy sheet 122 in the direction of transport of the sheet, and M is the copy magnification.

With reference to FIG. 7, a case involving a shift of image will be considered in which the area 121*b* to be copied of the document 121 is to be copied on a copy area 122*b* of the copy sheet 122 having ½ the size of the document 121 in the scanning direction. In the usual copy mode, the document is scanned from the scanning start position S over the usual scanning length Sn given by ls/M, i.e. by the copy sheet size and the magnification. When the magnification is assumed to be 1× for a simplified description, Sn=ls. The scanning length Sn therefore fails to cover the entire area 121*b* to be copied to result in a lack of the copy image. For the copy area 121*b* of the document 121 to be copied on the sheet 122 over the area 122*b* in the usual copy mode, an amount of shift of the image on the document 121, i.e. +lm must be considered.

Further in the case where the area 121*b* to be copied of the document 121 is deflected toward the scanning start position within the usual scanning range and is to be copied on the copy area 122*b* of the copy sheet 122 with a shift of the image in the reverse direction as seen in FIG. 8, the scanning length needed can be smaller than the usual scanning length Sn by lm which is the amount of shift of the image required for copying the area 121*b* on the area 122*b*.

To sum up, the scanning length Sm required for the upstream forward shift of the document image with respect to the document scanning direction is Sn+lm, while the scanning length Sm required for the downstream rearward shift is Sn−lm. This relation can be expressed by:

$$Sm = \frac{ls}{M} \pm lm \qquad (1)$$

Unless the scanning length is at least Sm, a defective copy image will be obtained.

With the first embodiment of the invention, therefore, the document is scanned over the required length Sn calculated from the magnification and the size of copy sheet 122 in the usual copy mode to eliminate excessive scanning movement and scanning time, while in an edition copy mode, the document is scanned over a full range by simple control means irrespective of the shift of the image, magnification, etc. to preclude a defect from occurring in the copy image owing to insufficient scanning.

FIG. 3 shows an operation panel 42 connected to a CPU 41 serving as the control means. The operation panel has usual members, i.e., a copy start key 20, number entry keys 22 for entering the number of copies or magnifications, clear/stop key 21 for clearing inputs on the operation panel or stopping the operation, sheet number display 23, automatic exposure key 29, automatic exposure display 26, exposure setting key 28, exposure step display 27 for indicating a particular step by exposure setting, magnification setting key 32 and magnification display 25. The panel is further provided with an edition mode key 30, forward shift selection key 31*a*, rearward shift selection key 31*b* and a display 24 for indicating the amount of shift.

The CPU 41 receives inputs from a sensor 46 for detecting the size of copy sheets 122 in the paper feeder 15 and from other members, and feeds outputs to a scan motor 43 for driving the first and second carriages 2, 5, lens drive motor 44 for shifting the lens 8 for varying the magnification, main motor 45 for the copying machine and other members. The sensor 46 is, for example, a reed switch or the like which is responsive to a magnet 48 carried by a paper cassette 47, as disclosed in U.S. Pat. No. 4,211,482.

Figure 9:
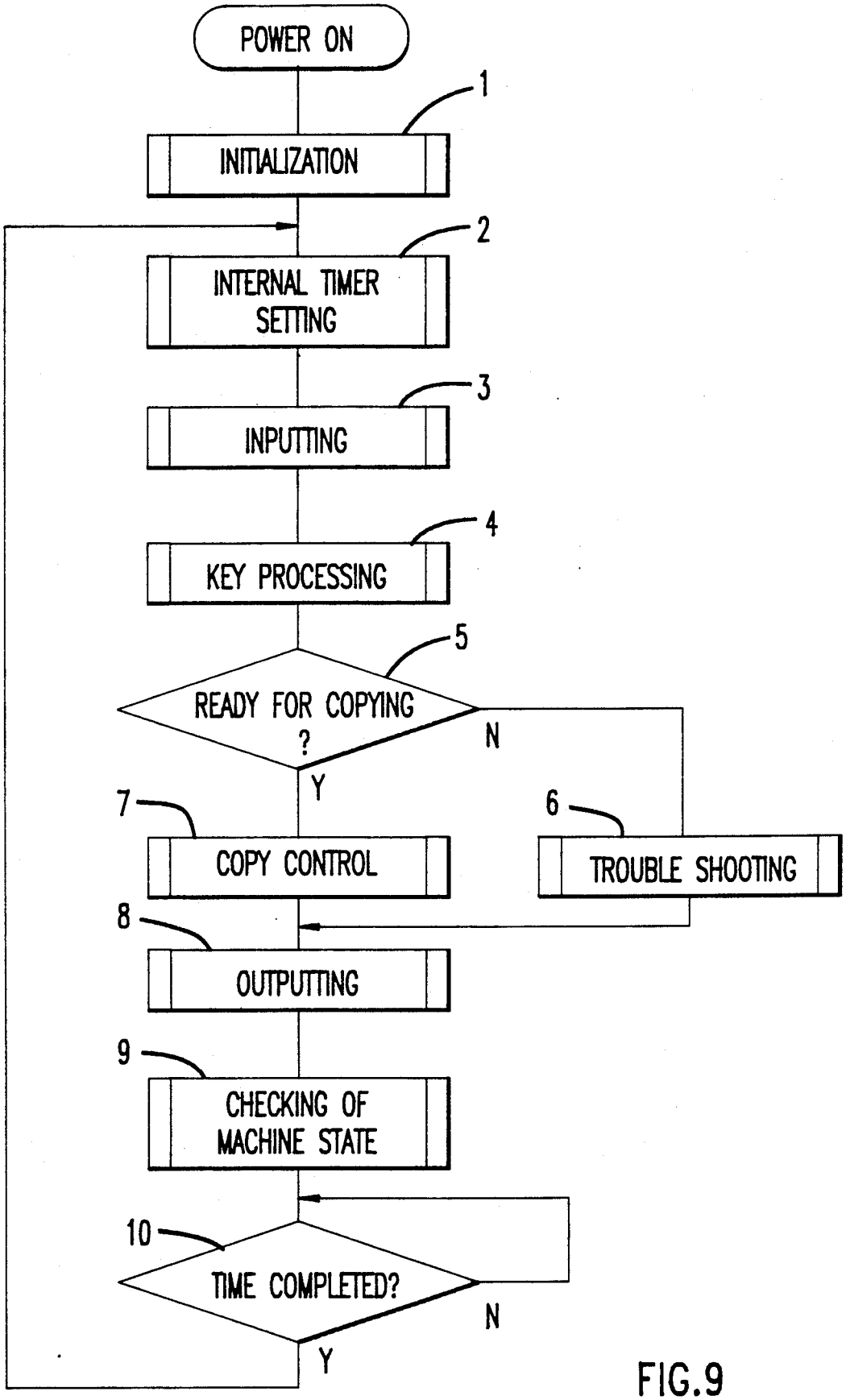
FIG. 9 is a main flow chart showing a copying operation control process according to a first embodiment of the invention.
Figure 10:
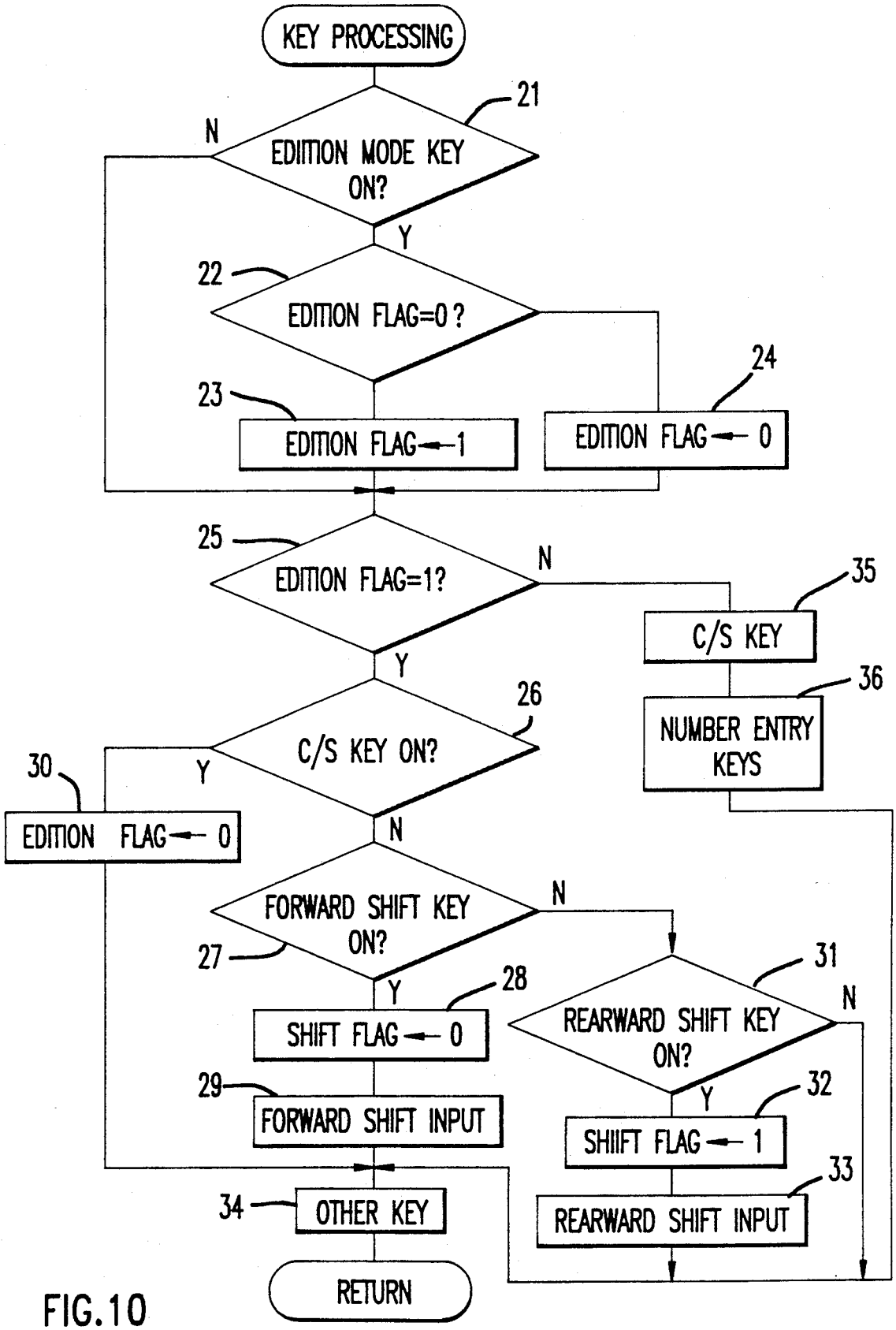
FIG. 10 is a flow chart showing a key processing subroutine included in the flow chart of FIG. 9.

A control process will be described in detail with reference to the flow charts of FIGS. 9 and 10.

The overall control process for the copying machine will be described first with reference to FIG. 9. When the power supply is turned on, the system is initialized to clear a RAM within the CPU and set the machine in a copy mode in step #1. In step #2, an internal timer of the CPU is set to determine the time required for the following control process, i.e. the time for one routine. In step #3, keys on the operation panel 42 are depressed to set the desired number of copies, magnification, edition mode, etc. The key processing subroutine shown in FIG. 10 is performed in step #4, followed by step #5 which inquires whether the machine is ready for copying. If the answer is in the affirmative, step #7 performs a copy control subroutine in conformity with the set mode. When the answer is negative, step #6 detects the trouble and remedies the trouble. Subsequently, control signals, display signals, etc. are produced in step #8. Step #9 checks the state of the copying machine as to the possible trouble, toner absence, paper absence, etc. Finally, step #10 checks the internal timer for the completion of its operation. When the operation has been completed, the sequence returns to step #2 to repeat the above operation again.

Next, the key processing subroutine of step #4 will be described in detail with reference to FIG. 10. Step #21 checks whether the edition copy mode key 30 is on. When it is on, step #22 checks an edition flag. This flag indicates the usual copy mode if it is "0" or represents the edition copy mode if it is "1". When the edition flag is "0", step #23 sets the flag to "1", setting the machine to the edition copy mode. If the edition flag is found to be "1", step #24 resets the flag to "0" to restore the machine to the usual copy mode. On completion of the above procedure, or if the key 30 is found off in step #21, the sequence proceeds to step #25, in which the edition flag is checked again. When the flag is "0", procedures with the clear/stop key 21 and number entry keys 22 in the usual copy mode are performed in steps #35 and #36 to clear the copy number setting, stop the copy operation and set the desired number of copies and magnification. If the edition flag is found to be "1" in step #25, steps #26 to #33 are performed. First, the clear/stop key 21 is checked. If the key is not on, the forward shift key 31*a* and the rearward shift key 31*b* are checked. Depending on which of these key is on, the shift flag concerned is set or reset, and the amount of shift is entered. When the clear/stop key 21 is on, the edition flag is reset to "0" to renew the data as to the preceding routine. After these steps, step #34 follows to execute procedures with other keys, such as the print key 20 and exposure setting key 28, whereupon the sequence returns to step #5 of FIG. 9.

Figure 11:
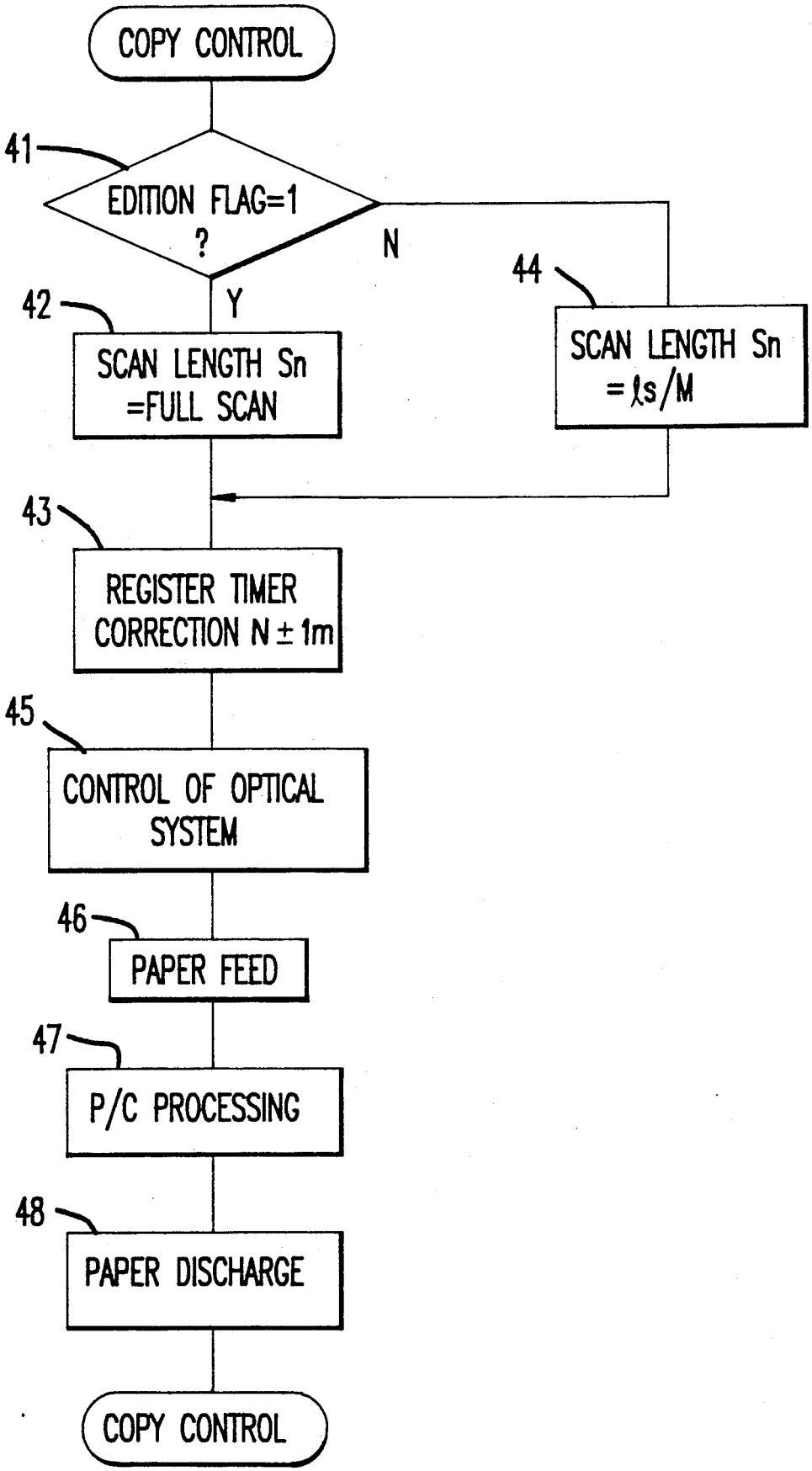
FIG. 11 is a flow chart showing a copy control subroutine included in the flow chart of FIG. 9.

With reference to FIG. 11 showing the copy control subroutine of step #7, step #41 checks the edition flag. If the flag is "0", step #44 follows to calculate the scanning length Sn from the paper size ls and the magnification M as conventionally done. When the edition flag is "1", the scanning length is set to the full length in step #42 regardless of the paper size ls or the magnification M. Step #43 then follows, in which when a shift flag is "0" (forward shift), a register timer is corrected by +lm to delay the operation timing of the register rollers 16 by the amount of shift, whereas if the shift is rearward, the register timer is corrected by −lm to advance the registration timing by the shift amount. The above process, when completed, is followed by step #45 for a shift of the lens according to the magnification and calculation of the scanning velocity, step #46 for paper feed, step #47 for the image forming system around the photosensitive member 10, and step #48 for the discharge of the sheet, whereby the copy cycle is completed. The sequence then returns to step #8 in FIG. 9.

Although the copying machine of the foregoing embodiment has a simple edition function, such that the shift of images can be set only on the main body of the copying machine, a specific image edition device is usable in combination with the machine for more complex image edition.

Next, a second embodiment of the invention will be described. With this embodiment, the scanning length Sm in the edition copy mode is determined as a minimum required from the amount of shift of image ±lm, the magnification M and the copy sheet size ls, and the document is scanned over the determined length. In this respect, the second embodiment differs from the first. The embodiment is therefore adapted to preclude the useless scanning movement and scanning time in the edition copy mode as well as in the usual copy mode.

Since the second embodiment otherwise has the same features as the first, the copy control subroutine only will be described with reference to the flow chart of FIG. 12.

Figure 12:
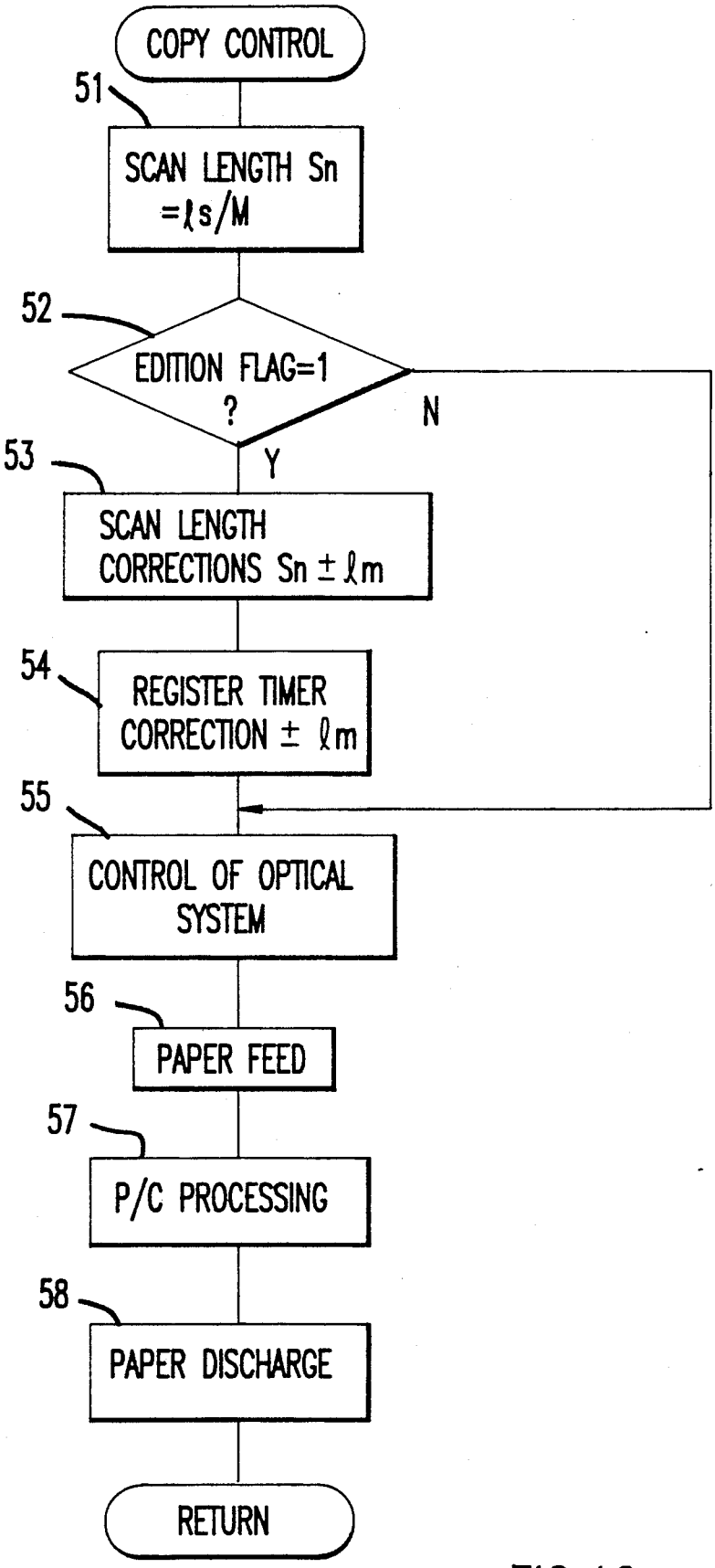
FIG. 12 is a flow chart showing a copy control subroutine according to a second embodiment of the invention.

As seen in FIG. 12, the scanning length Sn is first calculated from the sheet size ls and the magnification M. Next, an edition flag is checks in step #52. When the flag is "0", step #55 directly follows. When the flag is "1", indicating the edition mode, the sum of the calculated scanning length Sn plus an amount of shift lm is set as a scanning length Sm in step #53 if a shift flag is "0" (forward shift). If the shift flag is "1" (rearward shift), the calculated scanning length Sn minus the shift amount lm is set as the scanning length Sm. When the shift flag is "0" (forward shift), a register timer is corrected to delay the operation timing of the register rollers 16 by the shift amount lm in step #54. Conversely, in the case where the shift is rearward, the operation timing is advanced by the shift amount lm. The completion of the above procedure is followed by step #55 for a shift of the lens according to the magnification and calculation of the scanning velocity, and steps #56 and #58, whereupon the copy cycle is completed. The sequence then returns to step #8 of FIG. 9 mentioned with reference to the first embodiment.

Figure 13:
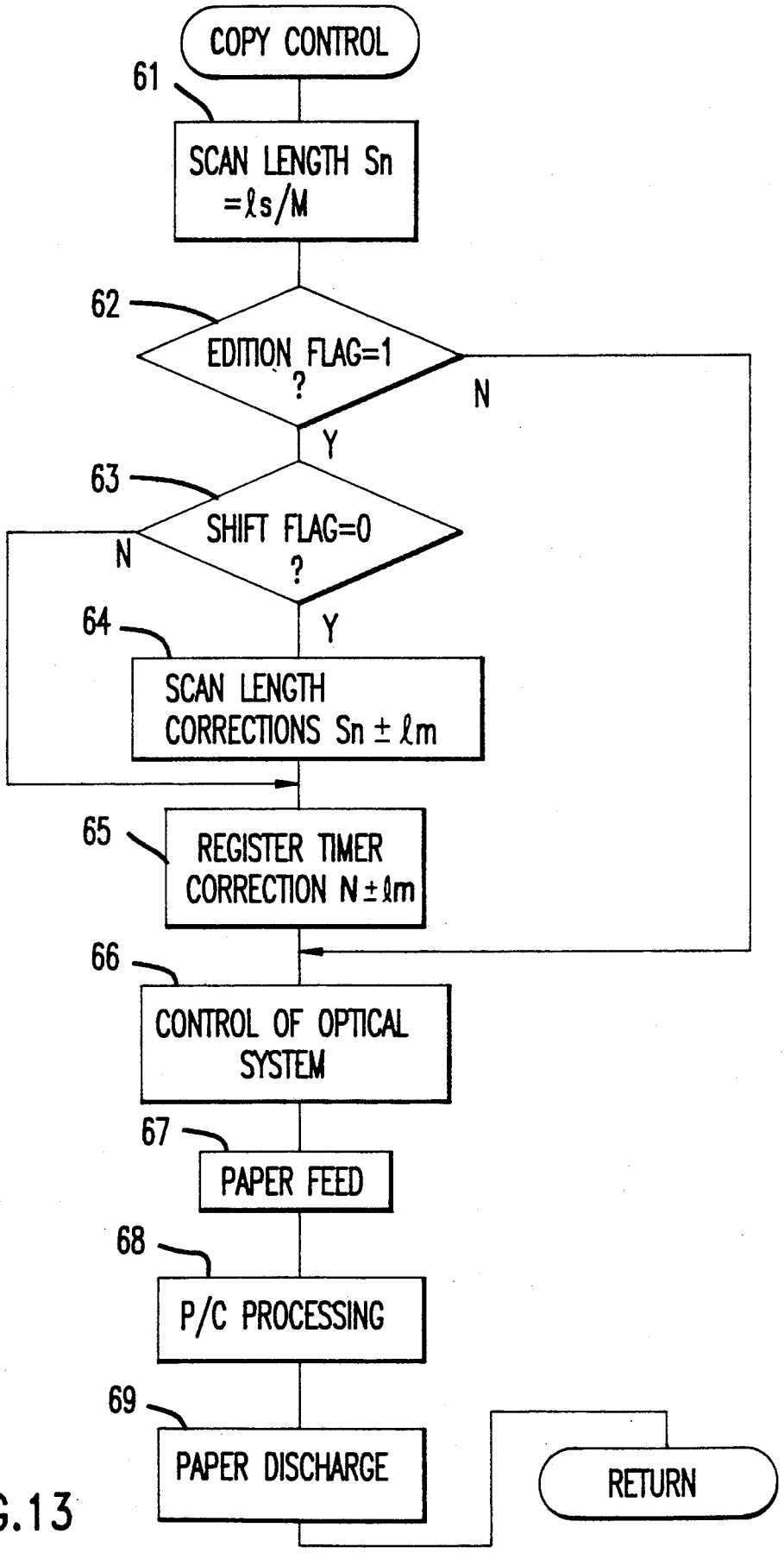
FIG. 13 is a flow chart showing a copy control subroutine according to a third embodiment of the invention.

When the image is to be shifted rearward in the second embodiment, the shift amount lm is subtracted from the calculated scanning length Sn to avoid the excessive scanning movement and scanning time involved in the calculated scanning length Sn. However, the value subtracted will usually be small, and a lack of image will not occur even if the subtraction is not made. According to the third embodiment shown in the flow chart of FIG. 13, therefore, step #63 is provided before scanning length correcting step #64 for detecting whether the shift is forward or rearward with reference to a shift flag. Thus, the scanning length is corrected in step #64 to preclude a defective image only when the shift flag is "0", indicating a forward shift. When the shift flag is "1", step #65 is performed for correcting the register timer without correcting the scanning length. This simplifies the scanning control procedure without substantially impairing the advantage of the second embodiment. The other steps according to the third embodiment are the same as the corresponding steps of the second embodiment and will not be described.

Figure 14:
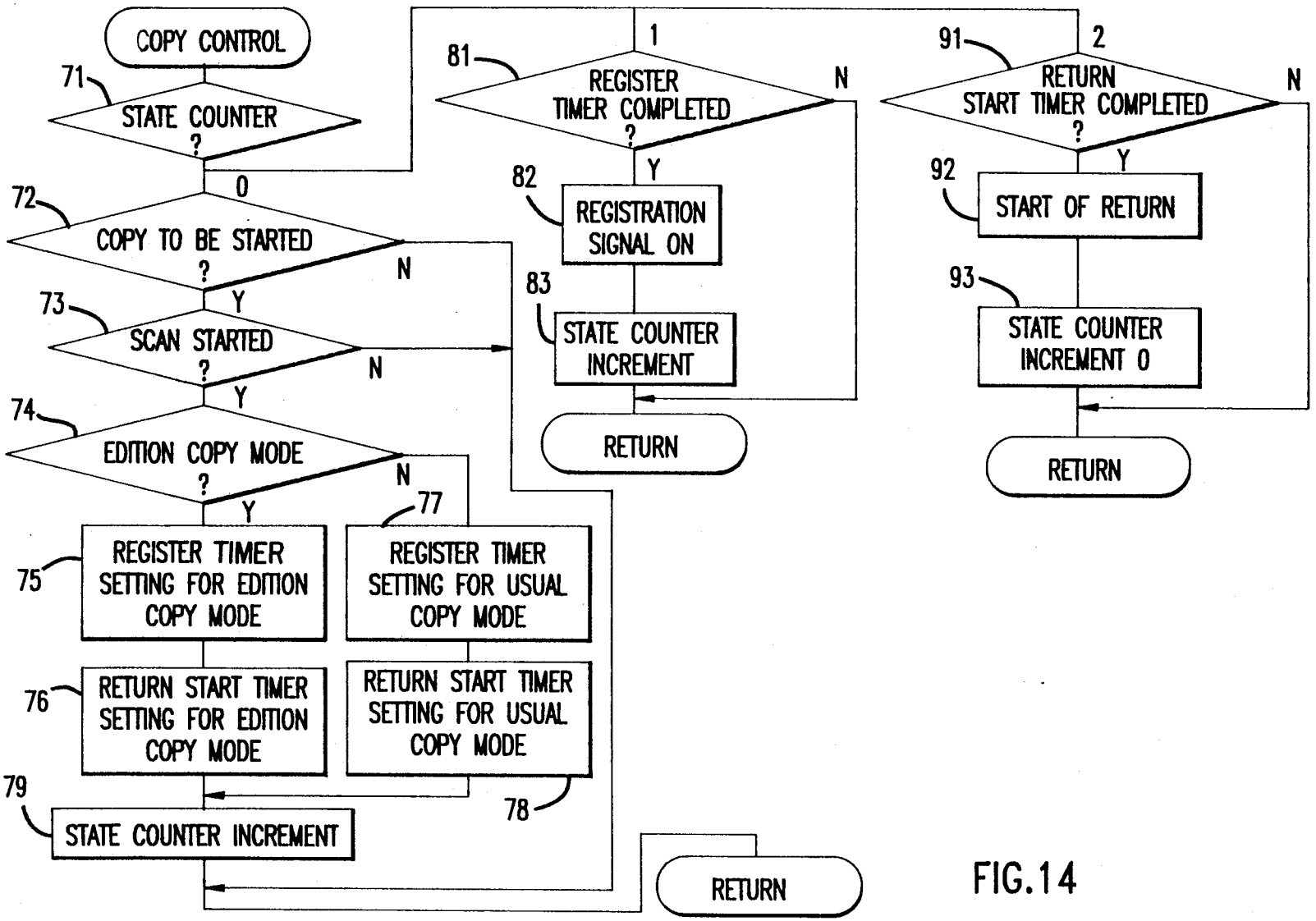
FIG. 14 is a flow chart showing a copy control subroutine according to a fourth embodiment of the invention.

FIG. 14 shows a fourth embodiment. When the edition copy mode is set in this embodiment, the scanning length is set to at least a length Sm calculated from the paper size, magnification and amount of shift of the image. The value beyond Sm provides freedom to the setting of scanning length in producing a flawless copy image, while the difference between the full scanning length and the length Sm serves to eliminate useless scanning movement and waste of time. The freedom thus afforded assures an advantage in using an existing mechanical timer for determining the scanning length when the timer is not exactly settable to a timer interval corresponding to the calculated scanning length Sm.

The control mode of the present embodiment will be described with reference to FIG. 14 showing a copy control subroutine.

First, step #71 checks a state counter as to whether the value is 0, 1 or 2. If it is 0, steps #72 et seq. follow, or steps #81 et seq. follow when it is 1. If it is 2, the sequence proceeds to steps #91 et seq.

In the case where the state counter is 0, step #72 inquires whether a copy operation is to be started. If the answer is in the affirmative, step #73 checks whether the scanner is ready to start, and step #73 persists until the scanner starts. Upon the start of the scanner, step #74 checks whether the machine is in the edition copy mode. If it is in this mode, a register timer is set in step #75. The register timer value is the register timer value for usual copying plus the value ±lm for delaying or advancing the registration timing in accordance with the amount of image shift in the edition copy mode. Next, step #76 follows to set a timer for providing a time interval before the start of return movement. As already stated, this timer value gives the scanning length of $Sm = ls/M \pm lm$ or greater length for the shift of the image in the edition copy mode. After the register timer and the return start timer have been set in steps #75 and #76, the state counter is incremented to 1 in step #79, followed by step #81.

On the other hand, when the machine is not found to be in the edition mode in step #74, a register timer for the usual copy mode is set in step #77. The timer value is so determined as to register the leading end of the copy sheet with the forward end of the image in the usual copy mode.

A timer for providing a time interval before the start of return movement in the usual copy mode is set in step #78. The value of this timer is adapted to effect scanning over the length of Sm=ls/M which is determined from the copy sheet size ls and the magnification M for the usual copy mode. As in the edition copy mode, step #79 then follows, in which the state counter is incremented to 1. The sequence then proceeds to step #81 also in this case.

When the state counter is 1, the sequence proceeds from step #71 to step #81, in which the system waits until the completion of operation of the register timer set in steps #74 to #78. Upon the completion of the timer operation, a registration signal is emitted in step #82, and the state counter is incremented to 2 in step #83.

Via step #71, the sequence then proceeds to step #91, in which the system waits until the return start timer set in step #82 completes its operation. On completion of the timer operation, return movement is initiated in step #92, followed by step #93 to reset the state counter to 0. The system subsequently remains in stand-by state before the start of the next copy cycle.

Although the present invention has been fully described by way of example with reference to the attached drawings, it is to be noted that various changes and modifications are apparent to those skilled in the art. Therefore unless otherwise such changes and modifications depart from the scope of the present invention, they should be construed as included therein.

What is claimed is:

1. An electrophotographic copying machine comprising:

a photosensitive member, optical means for projecting light on the photosensitive member to form a latent image of a document, the optical means having scanning means reciprocatingly movable a variable distance for exposing the document to light by scanning, image forming means for developing the latent image formed on the photosensitive member and transferring the developed image onto a copy sheet, means for giving a variable magnification, means for feeding the copy sheet to the image forming means, input means for entering the position on the copy sheet where the image is to be formed, and control means for controlling the operation timing of the feeding means according to the input from the input means and controlling the distance of movement of the scanning means according to the input of the input means, the magnification and the size of the copy sheet.

2. An electrophotographic copy machine as defined in claim 1 wherein the scanning means has a lamp for illuminating the document and mirrors for guiding the light reflected from the document to the photosensitive member.

3. An electrophotographic copying machine as defined in claim 1 wherein the input means includes a manual key for entering an amount of shift of the image from the normal image forming position in the scanning direction.

4. An electrophotographic copying machine as defined in claim 3 further comprising a display for indicating the amount of shift entered by the manual key.

5. An electrophotographic copying machine comprising:

a photosensitive member, a platen on which a document is adapted to be placed, optical means for projecting light on the photosensitive member to form a latent image of said document, the optical means having scanning means that is reciprocatingly movable by a variable distance relative to said platen for exposing the document to light by scanning, image forming means for developing the latent image formed on the photosensitive member and for transferring the developed image onto a copy sheet, means for feeding the copy sheet to the image forming means, input means for entering the position on the copy sheet where the image is to be formed, and control means for controlling the operation timing of the feeding means according to the input from the input means and for controlling the distance of movement of the scanning means so that the scanning means moves the length of said platen in the direction of the scanning direction without regard to the size of said document.

6. An electrophotographic copying machine as defined in claim 5 wherein the scanning means has a lamp for illuminating the document and mirrors for guiding the light reflected from the document to the photosensitive member.

7. An electrophotographic copying machine as defined in claim 5 wherein the input means includes a manual key for entering an amount of shift of the image from the normal image forming position in the scanning direction.

8. An electrophotographic copying machine as defined in claim 7 further comprising a display for indicating the amount of shift entered by the manual key.

9. An electrophotographic copying machine comprising:

a photosensitive member, optical means for projecting light on the photosensitive member to form a latent image of a document, the optical means having scanning means reciprocatingly movable a variable distance for exposing the document to light by scanning, image forming means for developing the latent image formed on the photosensitive member and transferring the developed image onto a copy sheet, means for feeding the copy sheet to the image forming means, means for giving a variable magnification, input means for entering the position on the copy sheet where the image is to be formed, and control means for controlling the operation timing of the feeding means according to the input from the input means, calculating the scanning distance required for scanning the document according to the input of the input means, the mangification and the size of the copy sheet and moving the scanning means at least the calculated scanning distance.

10. An electrophotographic copying machine as defined in claim 9 wherein the scanning means has a lamp for illuminating the document and mirrors for guiding the light reflected from the document to the photosensitive member.

11. An electrophotographic copying machine as defined in claim 9 wherein the input means includes a manual key for entering an amount of shift of the image from the normal image forming position in the scanning direction.

12. An electrophotographic copying machine as defined in claim 11 further comprising a display for indicating the amount of shift entered by the manual key.

13. An electrophotographic copying machine comprising:

a photosensitive member, optical means for projecting light on the photosensitive member to form a latent image of a document, the optical means having scanning means reciprocatingly movable a variable distance for exposing the document to light by scanning, image forming means for developing the latent image formed on the photosensitive member and transferring the developed image onto a copy sheet, means for feeding the copy sheet to the image forming means, copy mode selection means for selecting a usual copy mode wherein the document image is copied in the normal position on the copy sheet and an edition copy mode wherein the document image is copied as shifted from the normal position on the copy sheet, input means for entering the amount of shift of the image in the edition copy mode, and control means for controlling the distance of movement of the scanning means according to a specified magnification and the size of the copy sheet and for operating the feeding means with predetermined timing when the usual copy mode is selected by the selection means, and for controlling the distance of movement of the scanning means according to the specified magnification, the size of the copy sheet and the amount of shift and for altering the operation timing of the feeding means from the predetermined timing according to the amount of shift when the edition copy mode is selected by the selection means.

14. An electrophotographic copying machine as defined in claim 13 wherein the input means includes a manual key for entering the amount of shift of the image from the normal image forming position in the scanning direction.

15. An electrophotographic copying machine comprising:

a photosensitive member, a platen on which a document is adapted to be placed, optical means for projecting light on the photosensitive member to form a latent image of said document, the optical means having scanning means that is reciprocatingly movable by a variable distance relative to said platen for exposing the document to light by scanning, image forming means for developing the latent image formed on the photosensitive member and transferring the developed image onto a copy sheet, means for feeding the copy sheet to the image forming means, copy mode selection means for selecting a usual copy mode wherein the document image is copied in the normal position on the copy sheet and for selecting an edition copy mode wherein the document image is copied as shifted from the normal position on the copy sheet, input means for entering the amount of shift of the image in the edition copy mode, and control means for controlling the distance of movement of the scanning means according to a specified magnification and the size of the copy sheet and for operating the feeding means with predetermined timing when the usual copy mode is selected by the selection means, and for controlling the distance of movement of the scanning means so that the scanning means moves the length of said platen in the direction of the scanning direction without regard to the size of said document or said specified magnification and for altering the operation timing of the feeding means from the predetermined timing according to the amount of shift when the edition copy mode is selected by the selection means.

16. An electrophotographic copying machine as defined in claim 15 wherein the input means includes a manual key for entering the amount of shift of the image from the normal image forming position in the scanning direction.

17. An electrophotographic copying machine comprising:

a photosensitive member, optical means for projecting light on the photosensitive member to form a latent image of a document, the optical means having scanning means reciprocatingly movable a variable distance for exposing the document to light by scanning, image forming means for developing the latent image formed on the photosensitive member and transferring the developed image onto a copy sheet, means for feeding the copy sheet to the image forming means, input means for entering the position on the copy sheet where the image is to be formed, and control means for controlling the operation timing of the feeding means according to the input from the input means and controlling the distance of movement of the scanning means according to the input of the input means and the size of the copy sheet.

18. An electrophotographic copying machine as defined in claim 17 wherein the input means includes a manual key for entering the amount of shift of the image from the normal image forming position in the scanning direction.

19. An electrophotographic copying machine comprising:

a photosensitive member, optical means for projecting light on the photosensitive member to form a latent image of a document, the optical means having scanning means reciprocatingly movable a variable distance for exposing the document to light by scanning, image forming means for developing the latent image formed on the photosensitive member and for transferring the developed image onto a copy sheet, means for feeding the copy sheet to the image forming means, copy mode selection means for selecting a usual copy mode wherein the document image is copied in the normal position on the copy sheet and for selecting an edition copy mode wherein the document image is copied as shifted from the normal position on the copy sheet, first input means for entering the amount of forward shift of the image upstream with respect to the scanning direction, second input means for entering the amount of rearward shift of the image downstream with respect to the scanning direction, first control means, when the usual copy mode is selected by the selection means, for controlling the distance of movement of the scanning means to a predetermined distance according to a specified magnification and the size of the copy sheet as well as for operating the feed means with predetermined timing, and second control means, when the edition copy mode is selected by the selection means, for controlling the distance of movement of the scanning means to the predetermined distance plus the amount of shift for the forward shift if the amount is entered by the first input means and to the predetermined distance minus the amount of shift for the rearward shift if the amount is entered by the second input means as well as for operating the feeding means to delay the predetermined operation timing according to the amount of forward shift if the amount is entered by the first input means and to advance the predetermined operation timing according to the amount of rearward shift if the amount is entered by the second input means.

* * * * *